US005353963A

United States Patent [19]

Gorski et al.

[11] Patent Number: 5,353,963

[45] Date of Patent: Oct. 11, 1994

[54] POST MIX DISPENSER

[75] Inventors: Chris W. Gorski, Fort Atkinson; Michael Heinz, Watertown, both of Wis.

[73] Assignee: Karma, Inc., Watertown, Wis.

[21] Appl. No.: 71,726

[22] Filed: Jun. 2, 1993

[51] Int. Cl.[5] ..... B67D 5/56

[52] U.S. Cl. ..... 222/129.1; 222/214

[58] Field of Search ..... 222/129.1–129.4, 222/214, 144.5; 251/7–10

[56] References Cited

U.S. PATENT DOCUMENTS

| | | | |
|---|---|---|---|
| 3,141,573 | 7/1964 | Patch et al. | 222/129.1 |
| 3,323,681 | 6/1967 | Di Vette et al. | 222/129.1 |
| 3,750,908 | 8/1973 | Bauerlein et al. | 222/80 |
| 4,173,296 | 11/1979 | Marshall | 222/129.1 |
| 4,275,823 | 6/1981 | Credle et al. | 222/144.5 X |
| 4,493,441 | 1/1985 | Sedam et al. | 222/129.1 |
| 4,496,080 | 1/1985 | Farber et al. | 222/129.3 |
| 4,651,862 | 3/1987 | Greenfield, Jr. | 222/129.1 X |
| 4,687,120 | 8/1987 | McMillin | 222/129.1 X |
| 4,703,870 | 11/1987 | Sedam | 222/129.1 X |
| 4,708,266 | 11/1987 | Rudick | 222/129.1 X |
| 4,960,228 | 10/1990 | Takahashi et al. | 222/129.1 |

*Primary Examiner*—Andres Kashnikow
*Assistant Examiner*—Kenneth DeRosa
*Attorney, Agent, or Firm*—Andrus, Sceales, Starke & Sawall

[57] ABSTRACT

A post mix liquid dispensing system for combining a concentrate with a diluent including an arrangement in which the diluent is self-contained within the system, independent of any external diluent source such that the system is portable with respect to the diluent and concentrate. A concentrate pump having a pair of rollers cooperating with a rotor rotatably driven within a fixed race by a motor and spring biased into and out of clamping engagement with a conduit carrying the concentrate forces concentrate through the conduit during rotation of the rotor. The concentrate pump interacts with a diluent pump to transfer concentrate and diluent into a mixing valve for dispensing of a food or beverage of uniform consistency.

2 Claims, 4 Drawing Sheets

FIG. 5
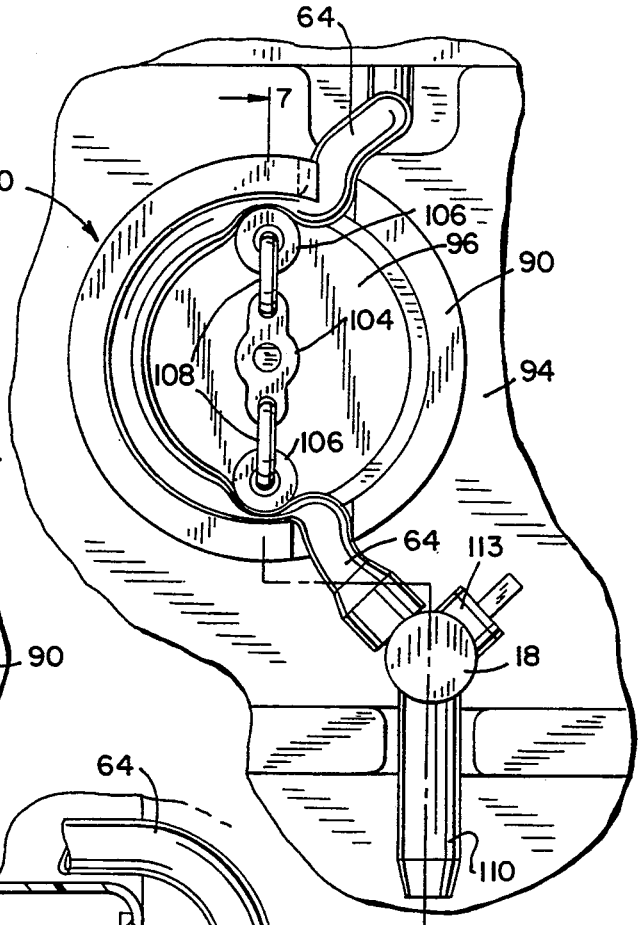
FIG. 6
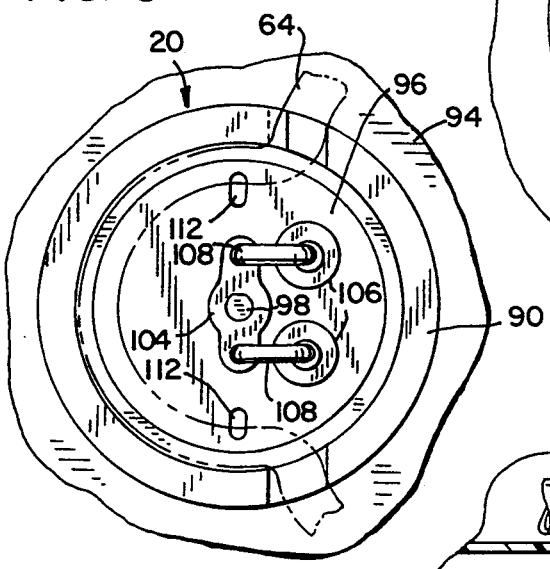
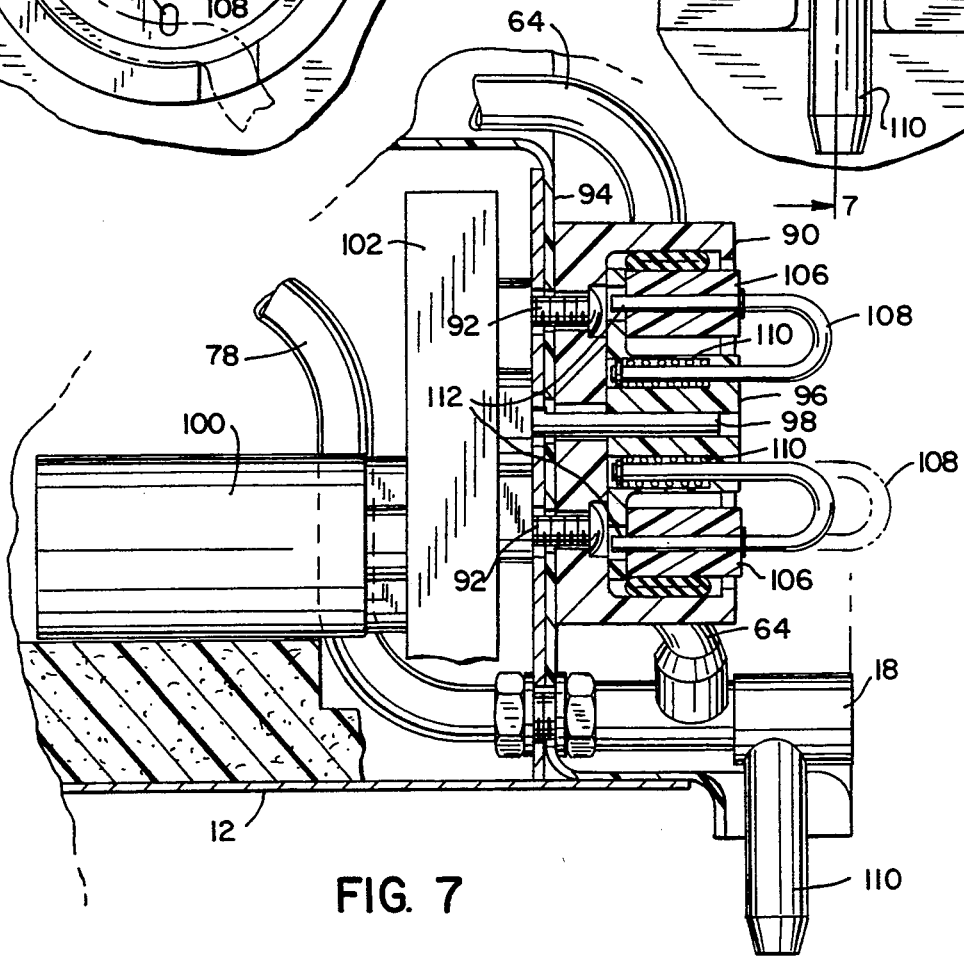
FIG. 7

POST MIX DISPENSER

TECHNICAL FIELD

The invention relates generally to an apparatus for dispensing liquid food and beverages and, more particularly, pertains to an apparatus for post mix combination of a concentrated food and beverage ingredient such as a juice or fruit drink concentrate with a diluent such as water so as to produce a uniformly homogenous mixed beverage.

BACKGROUND OF THE INVENTION

Various food and beverage systems are known in the art for blending a concentrate of relatively high viscosity with a diluent having a relatively low viscosity. Typical post mix food and beverage dispensers are designed to separately store and to automatically combine at the time of dispensing a concentrate and a diluent such as water at a predetermined ratio in order to consistently produce a food or beverage which is acceptable for consumption.

Commercially known available post mix juice and fruit drink dispensers require a connection to an external diluent source or waterline. Two beverage systems which are presently marketed are illustrative of the beverage dispensing art. The Jet Spray Company of Norwood, Massachusetts and Alco Dispensing Systems of Carol Stream, Illinois distribute post mix beverage dispensers which deliver juice concentrate from a storage vessel to a dispensing spout along with water from a waterline connection outside the dispenser. The waterline connection needed to feed these dispensers emanates from the main waterline of a premise. The waterline connected to such typically commercially available post mix dispensers necessitates a particular sized tubing generally $\frac{1}{4}''$ to $\frac{3}{8}''$ ID. In addition to the size of the waterline connection, a minimum water pressure is also required which is usually of the order of 25 lbs./psi.

The need for a waterline connection requires a food service operator to have immediate space available for placement of the dispenser. The available space must be substantially adjacent the main waterline of the operator's premise so that a secondary waterline tapped off the main waterline can be joined to the post mix dispenser. Once the dispenser is connected to the premise water supply, it must remain connected at all times in order to be utilized to dispense drinks. The dispenser is further dependent on the proper operability and quality of the premise water supply. If a problem arises and the premise water supply is turned off or fluctuates in pressure, the post mix dispenser will not deliver a reconstituted beverage of uniform consistency available for consumption. Likewise, the taste of the blended product may vary due to the purity of the water supplied. Since currently available post mix juice and fruit drink dispensers require an external waterline connection, can be restrictedly used only in areas of the premise where a waterline connection can be made, and are dependent on the operability and quality of the premise water supply, little convenience and versatility is offered to the operator. Accordingly, it is desirable to produce a beverage dispensing system independent of any external source of diluent, such as water, which is more convenient for operator use. In this regard, it would be advantageous if a dispenser could be designed to include a completely self-contained, replenishable and quality-controlled diluent source which would create a portability of the dispenser unknown in the prior art.

It is further desirable that a beverage dispensing system yield a reconstituted beverage of uniform consistency. Such objective can be attained by better control of the forces used to deliver the concentrate and diluent. In the case of the diluent, as discussed previously, a dispenser having a waterline connection is dependent on the waterline pressure provided directly to the dispenser or in conjunction with an auxiliary water pump. In the case of the concentrate, liquids of varying viscosity must be properly pumped and replaced in an easily serviceable manner. One example of a concentrate pump which meets this general criteria is shown in U.S. Pat. No. 3,750,908, issued Aug. 7, 1973 to Bauerlein, et al. In this arrangement, a peristaltic type pump consisting of a rotatable shaft and a helical flange serves to provide pumping action of a concentrate and also allow for installation and removal of the concentrate from the dispenser. A further showing of a peristaltic pump used to transfer concentrate is disclosed in U.S. Pat. No. 4,173,296, issued Nov. 6, 1979 to Marshall. Besides the fact that both of these pumps operate in dispensers requiring a waterline connection, further improvement in the design efficiency and operability of concentrate pumps need to be considered. More importantly, the pumping capability for both the concentrate and diluent must be upgraded and combined to produce a blended beverage product of uniform consistency.

SUMMARY OF THE INVENTION

The present invention advantageously provides an improved beverage dispensing system having a unique arrangement of a captive diluent supply which is combined with a concentrate to maintain a desired blend and assure that each serving of mixed beverage possesses substantially the same taste. The improved system is particularly versatile and lends itself to improved portability.

These and other advantages are realized in one aspect of the invention by a liquid dispensing system having a housing for proportioning a concentrate with a diluent, the diluent being self-contained within the housing, independent of any external diluent source and creating a portability with respect to the diluent and concentrate.

In a highly preferred embodiment, the invention contemplates a liquid dispensing system for proportioning a concentrate with a diluent wherein the system housing includes a first container self-contained therein for dispensing the concentrate and a conduit operatively connected with the first container. A second container is also self-contained and open to atmosphere for dispensing a diluent which is combined with the concentrate in various proportions in a mixing valve prior to dispensing. A concentrate pump in the housing non-invasively forcing concentrate into the mixing valve includes a fixed race and a plurality of rollers cooperating with a rotor rotatably driven by a motor. The rollers are spring biased into and out clamping engagement with the conduit to force concentrate through said conduit during rotation of the rotor. A diluent pump is also provided in the housing for forcing the diluent into the mixing valve so as to produce a blended beverage product of uniform consistency.

The concentrate pump includes a hub alignable with the rollers in a linear array when the pump is in an operative condition. The rollers are collapsible with respect to the hub when the pump is in a service condition. Otherwise stated, the conduit is engagable with the rollers in the operative condition and disengageable with the rollers in the service condition.

BRIER DESCRIPTION OF THE DRAWINGS

The invention will become better understood by reference to the following detailed description of the preferred exemplary embodiment when read in conjunction with the appended drawing wherein like numerals denote like elements and:

FIG. 5 is an enlarged, fragmentary detail view of one of the concentrate pumps as seen in FIG. 3 in an operating condition;

FIG. 6 is an enlarged, fragmentary detail view of one of the concentrate pumps shown in FIG. 5 in a service condition;

FIG. 7 is a cross-sectional view of the concentrate pump taken on line 7—7 of FIG. 5;

DETAILED DESCRIPTION OF THE PREFERRED EMBODIMENTS

The food and beverage dispenser of the present invention is a post mix machine which is adapted to automatically combine food and beverage concentrate such as juice, fruit drink, or coffee concentrate with a diluent, and discharge the mixture on demand. Most typically, when a machine is used as a food and beverage dispenser, it may be utilized for dispensing metered quantities of two or three separate liquid foods and beverages such as orange juice, fruit punch and iced tea. In most situations, the concentrate is a liquid of relatively high viscosity such as a syrup, while the diluent is a liquid of relatively low viscosity, such as water. However, it should be understood that the principles of the present invention may also be employed in other dispensing applications.

Figure 1:
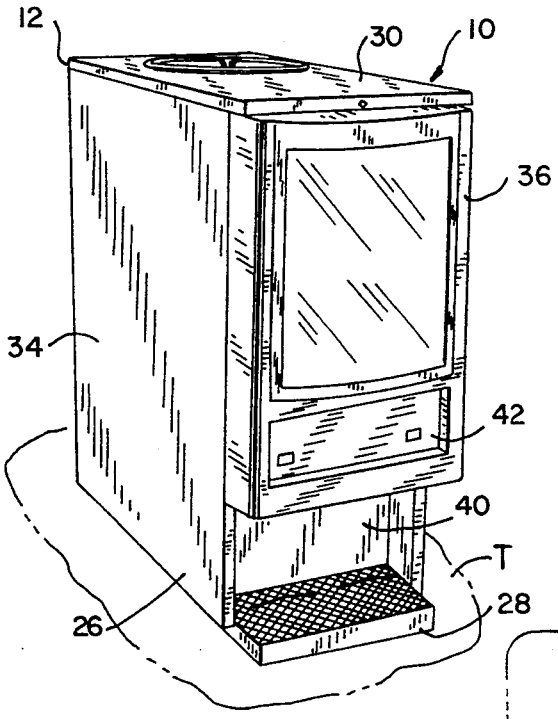
FIG. 1 is a front perspective view of a post mix dispensing machine embodying the present invention.
Figure 2:
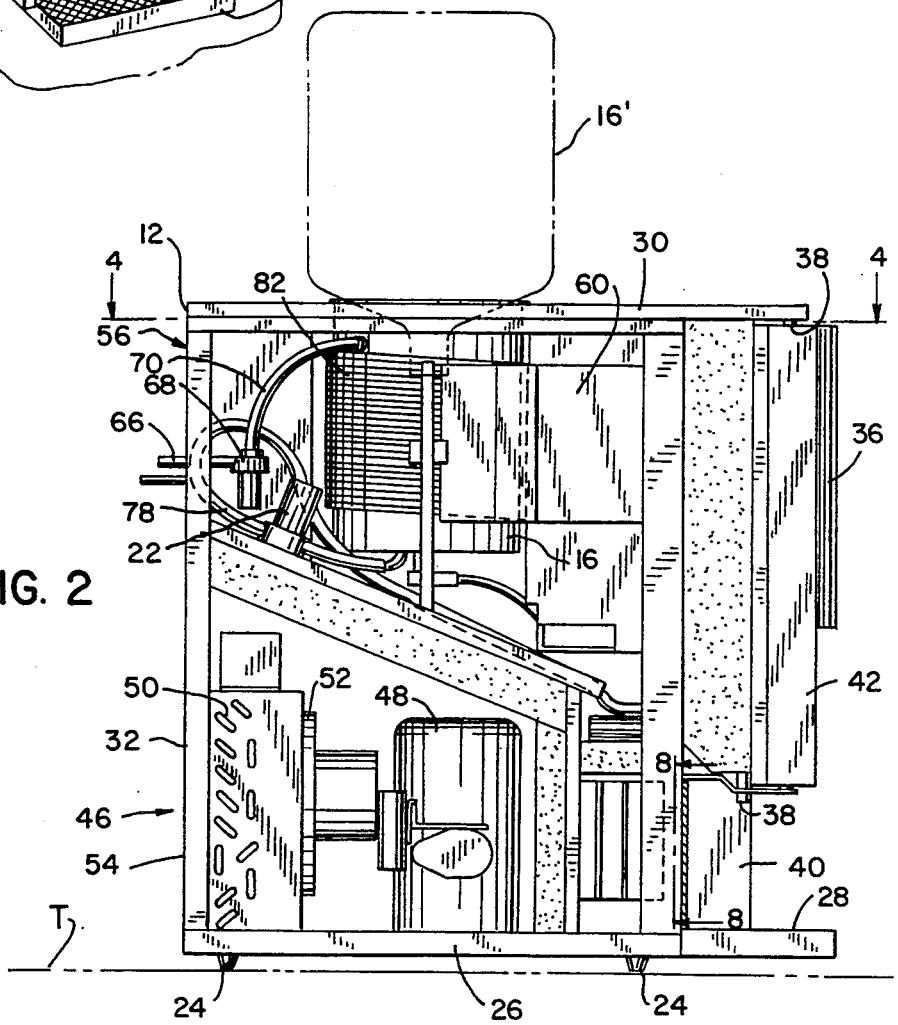
FIG. 2 is a side elevational view of the dispensing machine shown in FIG. 1 with a portion of its housing broken away.
Figure 3:
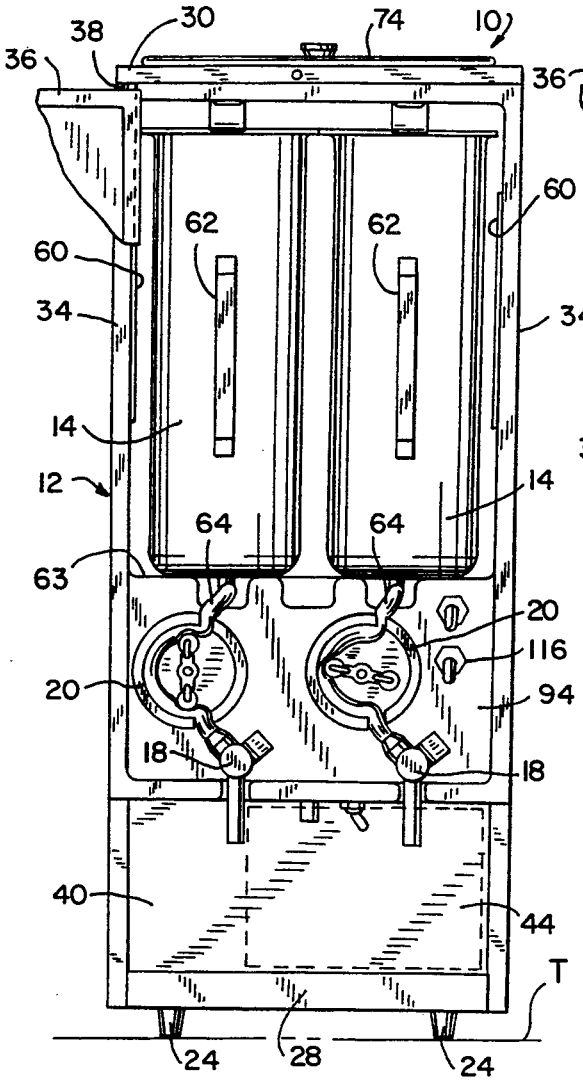
FIG. 3 is a front elevational view of the dispensing machine with its hinged door swung open to show use of its concentrate pumps and containers.

The food and beverage dispenser 10 illustrated in the drawings is intended to be placed on a counter top or table T and its overall dimensions may be, in one embodiment, 25" high, 11" wide and 25" deep. Referring to FIGS. 1–3, dispenser 10 is an upright, box-like structure comprising a main housing 12 for enclosing a pair of concentrate containers 14, a diluent container 16, a pair of mixing valves 18, a pair of concentrate pumps 20 and a pair of diluent pumps 22, all of which will be described in further detail hereafter.

Housing 12 is supported by four adjustable legs 24 attached to a base 26 adjacent its four corners, Projecting forwardly from base 26 is a generally conventional drip tray and drink container support 28 upon which paper cups or similar containers (not shown) are intended to be placed for filling with food and beverage dispensed from dispenser 10. Housing 12 is further formed by a top wall 30, a rear wall 32, side walls 34, a swingable door 36 carried by hinges 38, and a lower front bracket 40. A suitable control panel 42 is included on the exterior lower portion of door 36 and serves to activate the dispensing cycles when touched by the user of dispenser 10. Another control panel 44 for making adjustments to the strength and volume of the food and beverage to be dispensed and to the operating mode of dispenser 10 is located behind lower front bracket 40.

Figure 11:
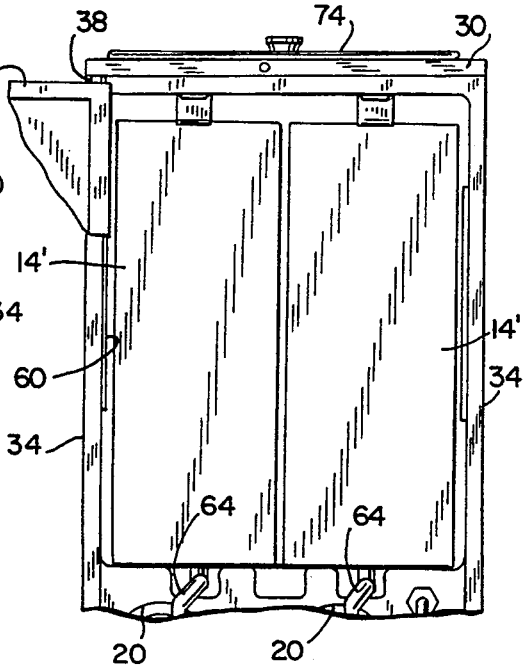
FIG. 11 is a front elevational view similar to FIG. 3 showing alternative concentrate containers.
Figure 4:
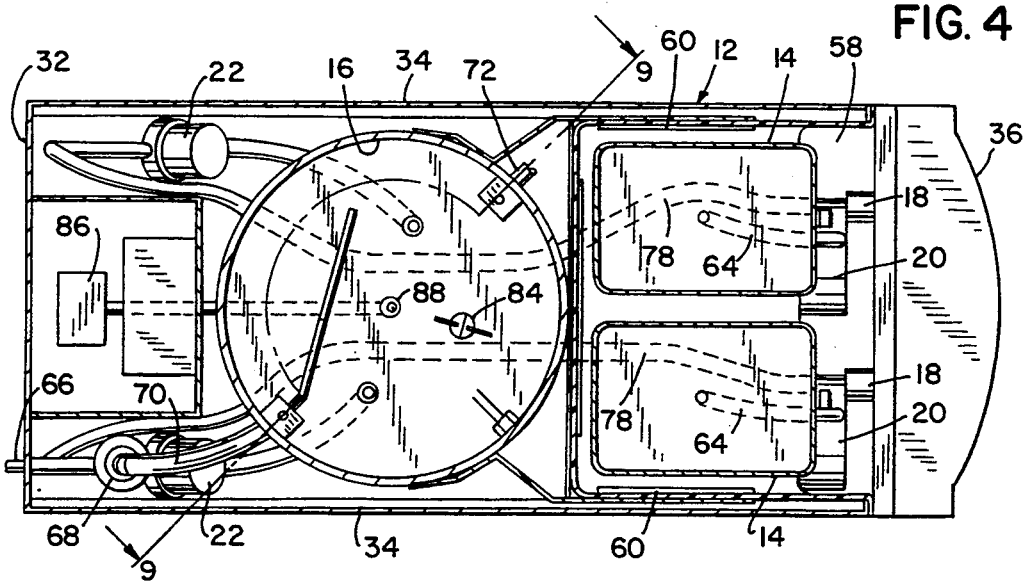
FIG. 4 is a top view of the dispensing machine shown in FIG. 1.

As seen in FIG. 2, housing 12 has a lower portion 46 which contains a substantial part of a refrigeration system including a compressor 48 and condenser 50, as well as a fan 52 and cooling fins 54. An upper portion 56 of dispenser 10 includes an insulated compartment 58 closed at its front by hinged door 36, normally held closed by a suitable latch (not shown). Compartment 58 contains an aluminum liner 60 which is open at the front and which receives the pair of self-contained concentrate containers 14, which are shown in FIGS. 3 and 4 preferably in the form of removable stainless steel wells manually refillable with concentrate. Wells 14 have handles 62 and are slidably disposed on a support shelf 63 of compartment 58. Alternatively, wells 14 may be replaced by bag-in-box or other disposable type containers 14 (FIG. 11) in which a concentrate source is exhausted, thrown away, and suitably replaced. Although not illustrated, containers 14' may be adapted as well known with sensors to indicate a low level of concentrate therein. Extending from the bottom of each container 14, 14' is a flexible conduit 64 cooperatively related to each concentrate pump 20 and removably connected to each mixing valve 18.

As a salient feature of the invention, dispenser 10 includes self-contained, metallic diluent container 16 which is intended to provide a diluent source such as water either from a waterline connection 66 or from an onboard refillable reservoir completely independent of such external source so as to create a portability with respect to concentrate and diluent unknown in the prior art. In the preferred embodiment, diluent is either delivered into reservoir 16 via waterline connection 66 and associated inlet valve 68 and tubing 70, or is manually replenished through the top of reservoir 16 or is supplied by a replaceable diluent vessel 16' such as a water bottle (FIG. 2) in direct communication with reservoir 16. Tubing 72 serves as an overflow conduit. In the first two applications identified above, a removable cover 74 is fastened to the top wall 30 by suitable fasteners 76. In the examples involving manual replenishing of reservoir 16 or use of replaceable diluent vessel 16', it can be stated that such applications are open to atmosphere or gravity fed such that there is no dependence whatsoever on the existence, operability or parameters of the well known waterline connection. In all such cases, however, the pair of water pumps 22 are utilized to consistently draw diluent through tubing 78 from reservoir 16 into each mixing valve 18.

Figure 9:
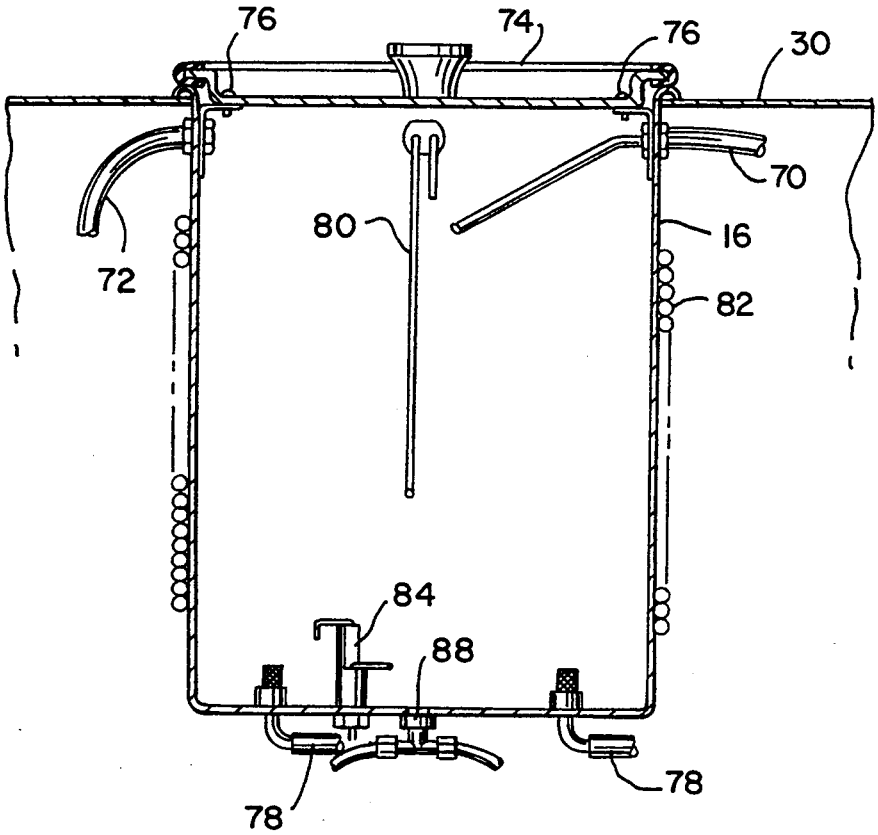
FIG. 9 is a cross-sectional view of the diluent container taken on line 9—9 of FIG. 4.

Focusing on FIG. 9, diluent container (reservoir) 16 includes a diluent level sensor 80 to monitor the diluent supply. Another distinctive feature of the invention is included in the refrigeration system having an evaporator coil 82 surrounding the outside only of diluent container 16. This arrangement maintains the diluent in container 16 at substantially 34° F. and builds an ice ring on the opposite side (inside) of container 16. A sensor 84 continually compares resistance readings and sequentially activates and deactivates compressor 48 at the proper times to maintain proper diluent temperature. An air pump arrangement 86 provides a stream of air through the bottom 88 of container 16 in order to prevent diluent stratification or temperature differentials so that the diluent temperature is evenly distributed. Evaporator coil 82 also serves to cool concentrate in containers 14, 14' by convection cooling via aluminum liner 60 which acts as a heat sink to preserve the concentrates in a 35°–40° F. range.

Turning now to FIGS. 5–7, each concentrate pump 20 is a molded plastic arrangement including a fixed circular race 90 mounted by fasteners 92 to an inner front wall 94 of housing 12. A rotor 96 is rotatable within race 90 about a shaft 98 which is turned by an electric motor 100 operating through a gear box 102. Rotor 96 includes a stationary central hub 104 on each side of which is equidistantly mounted a roller 106 which is connected to hub by a U-shaped wire form 108. Each wire form 108 is biased by a spring 110 to positively lock wire form 108 and its associated roller 106 into a detent hole 112 in rotor 96 when the pump is in an operative condition. In this position, rollers 106 and hub 104 assume a linear array wherein conduit 64 is squeezed by rollers 106 against the inside of race 90. The rotating action of rotor 96 within race 90 serves to force concentrate through conduit 64 in a peristaltic manner such that concentrate is eventually delivered to each mixing valve 18.

When concentrate has been exhausted, conduit 64 may be quickly released by simply pulling outwardly on wire form 108 and swinging or collapsing rollers 106 with respect to hub 104 so that the pump is in a service condition. It should be appreciated that this particular structure advantageously lends itself to creating a simple, quick loading concentrate pump which is immediately accessible from the front of housing 12 merely by opening door 36.

Figure 10:
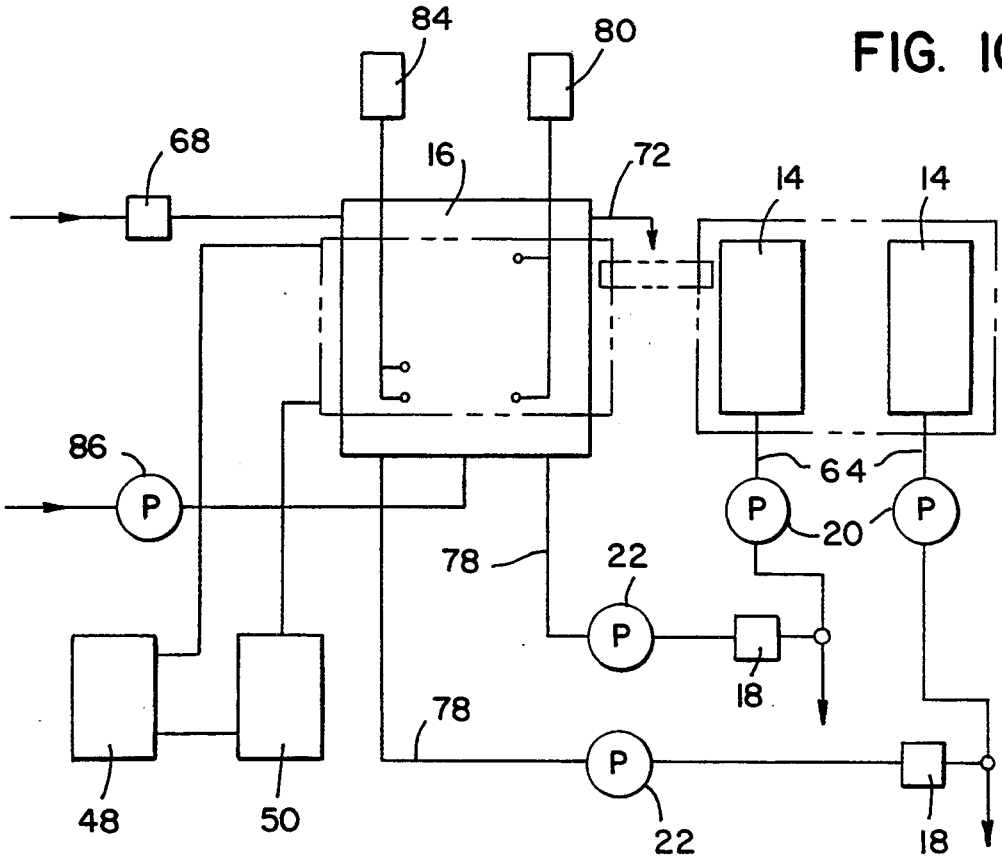
FIG. 10 is a schematic of the dispensing machine shown in FIG. 1.

Referring to FIG. 7, concentrate from conduit 64 and diluent from tubing 78 are merged into each mixing valve 18 before being dispensed as a mixture through a dispensing spout 110. A shut off valve 113 is included at mixing valve 18 when it is desired to stop the flow of diluent. FIG. 10 is a schematic representation of the aforementioned dispensing system emphasizing the simplicity of design and versatility in application. The dispensing system includes a source of electrical power for driving the necessary components described and providing lighting and the necessary controls.

Figure 8:
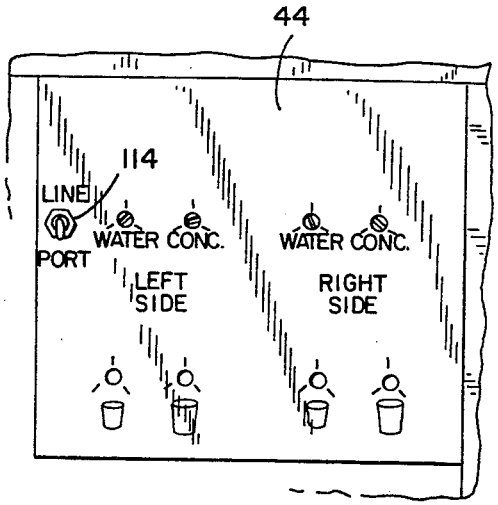
FIG. 8 is an enlarged, fragmentary detail view of the concentrate and diluent adjustment panel of the dispensing machine shown in FIG. 1.

In operation, when a switch 114 (FIG. 8) is set in the portable mode, the unit is activated by flipping an on-off switch 116 (FIG. 3). Assuming concentrate and diluent supplies are established, a cup or like container is placed beneath desired spout 110. With the cup positioned, the user desiring to obtain the desired mixed food and beverage product merely pushes control panel 42 of the appropriate product. This activates electric motor 100 which in turn drives each concentrate pump 20 to force concentrate through conduit 64 into mixing valve 18. Simultaneously, diluent is drawn from self-contained diluent container 16 by water pump 22 into mixing valve 18 and is mixed in the proper proportion to yield a product of uniform consistency. If it is desired to alter the set proportion of concentrate to diluent or change the volume of the mixture being dispensed, one only needs to access the panel 44 behind the lower front bracket 40 to change the speed of the concentrate or diluent pumps, or the timed portion control.

It should be recognized that the present invention greatly enhances the portability of post mix dispensing systems and allows a user the flexibility of using a standard waterline connection or a self-contained diluent supply independent of external waterline source. In providing the latter, the present invention enables a user to locate the dispenser at a site removed from a waterline where only electrical power is necessary. Because of the reliable nature of the self-contained pumps, a more homogenous product can be expected. In addition, the inventive arrangement permits control of water purity which has become a concern both here and abroad. Unlike prior art systems which present difficulty in servicing, the present invention provides an improved concentrate pump structure which is extremely accessible to the user.

While the invention has been described with reference to a preferred embodiment, those skilled in the art will appreciate that certain substitutions, alterations and omissions may be made without departing from the spirit hereof. For example, while the preferred form of the invention focuses on a portable diluent supply, the dispenser would still function with a waterline connection at the appropriate line setting. Likewise, the invention may be used with a heating system to dispense hot foods and beverages such as soups and the like. Also, while it is the usual practice to use liquid concentrates, it should be understood that in some instances, concentrates may take the form of powders. Accordingly, the foregoing description is meant to be exemplary only and should not be deemed limitative on the scope of the invention set forth in the following claims.

We claim:

1. A liquid post mix dispensing apparatus for proportioning a concentrate with a diluent, said apparatus comprising:

a main housing;

first container means self-contained within aid main housing for dispensing said concentrate;

conduit means operatively connected with said first container means;

second container means self-contained within said main housing and completely open to atmosphere for dispensing said diluent;

mixing valve means in said main housing for combining said concentrate and said diluent in various proportions prior t dispensing;

concentrate pump means in said main housing for non-invasively forcing said concentrate into said mixing valve means, said concentrate pump means including a fixed race, a plurality of rollers cooperating with a rotor rotatably driven within said racy by a motor, said rotor including a central hub, a U-shaped wire clip connecting each of said rollers with said hub, said rollers being spring biased into and out of clamping engagement with said conduit means during rotation of said rotor; and diluent pump means in said main housing for forcing said diluent into said mixing valve means.

2. A liquid post mix dispensing apparatus for proportioning a concentrate with a diluent, said apparatus comprising:

a main housing;

first container means self-contained within said man housing for dispensing said concentrate;

conduit means operatively connected with said first container means;

second container means self-contained within said main housing and completely open to atmosphere for dispensing said diluent;

mixing valve means in said main housing for combining said concentrate and said diluent in various proportions prior to dispensing;

concentrate pump means in said main housing for non-invasively forcing said concentrate into said mixing valve means, said concentrate pump means including a fixed race, a plurality of rollers cooperating with a rotor rotatably driven within said race by a motor, said rotor including a central hub, a U-shaped wire clip connecting each of said rollers with said hub, said rollers being spring biased into and out of clamping engagement with said conduit means to force said concentrate through said conduit means during rotation of said rotor; and diluent pump means in said main housing for forcing said diluent into said mixing valve means;

wherein said rollers and said hub are aligned in a linear array when said pump means is in an operative condition and said rollers are collapsible with respect to said hub when said pump means is in a service condition.

* * * * *